United States Patent [19]

Fernandes

[11] Patent Number: 4,924,594

[45] Date of Patent: May 15, 1990

[54] DOUBLE CUT EDGER

[76] Inventor: Manuel Fernandes, 7726 Taylor Pl., Burnaby, British Columbia, Canada, V3N 3Z2

[21] Appl. No.: 214,177

[22] Filed: Jun. 30, 1988

[30] Foreign Application Priority Data

Jul. 24, 1987 [CA] Canada ..... 543003

[51] Int. Cl.[5] ..... B26B 29/02

[52] U.S. Cl. ..... 33/483; 33/492; 33/403; 33/566; 30/287; 269/1

[58] Field of Search ..... 33/483, 492, 566, 403, 33/404; 269/1, 285, 293, 295; 30/287, 289, 290, 294; 83/743, 745

[56] References Cited

U.S. PATENT DOCUMENTS

| | | | |
|---|---|---|---|
| 659,119 | 10/1900 | Adler | 269/295 |
| 1,341,445 | 5/1920 | Stanley | 269/295 |
| 1,560,417 | 11/1925 | Dreschler | 33/403 |
| 1,835,364 | 12/1931 | Woerner | 33/403 |
| 2,722,055 | 11/1955 | Rader | 33/483 |
| 3,373,781 | 3/1968 | Grosswald | 83/745 |
| 3,406,456 | 10/1968 | Schleich | 33/492 |
| 3,509,633 | 5/1970 | Fernandes | 30/289 |
| 3,608,197 | 9/1971 | McIvor et al. | 269/1 |
| 4,349,966 | 9/1982 | Marino et al. | 30/289 |

*Primary Examiner*—William A. Cuchlinski, Jr.
*Assistant Examiner*—Patrick R. Scanlon
*Attorney, Agent, or Firm*—Spensley, Horn, Jubas & Lubitz

[57] ABSTRACT

This invention pertains to a novel double cut edger which is useful for facilitating the cutting of edges of double lapped wall coverings and the like. An apparatus useful for assisting in cutter edging overlapping sections of adjacent surface coverings comprising an elongated body portion with at least one straight side, and at least one slot parallel with the straight side of the elongated body portion and penetrating through and extending substantially the length of the body portion.

7 Claims, 1 Drawing Sheet

DOUBLE CUT EDGER

FIELD OF THE INVENTION

This invention pertains to a novel double cut edger which is useful for facilitating the cutting of edges of double lapped wall coverings and the like.

BACKGROUND OF THE INVENTION

For many years, it has been traditional practice for commercial tradesmen engaged in the installation of wall coverings, ceiling coverings, and the like, with overlapping edges (double lapped edges) to use a conventional straight edge and a cutting blade in cutting through the overlapping edges of adjacent covering sheets. It is difficult in using such a straight edge to achieve a straight cut along the length of the double lap because it is difficult for the tradesman to apply firm pressure against the straight edges at all times and hence the straight edge tends to wiggle or move out of place as the cutting blade is drawn along one side of the straight edge. This is particularly so if the blade is at the top or bottom end of the straight edge, where the leverage caused by the pressure of the blade against the straight edge is greater. As a consequence, it is not unusual to see wavey or uneven edges at the joints between adjacent sheets of wall covering such as wallpaper or vinyl backed wall coverings, which are commonly used in many interior wall covering or decorating applications.

Another problem with using an ordinary straight edge is that to make the job pay the installer must work rapidly and this tends to cause the installer to attempt to minimize the number of times the straight edge must be moved along the edge cut. In other words, he will endeavour to draw the cutting knife from the top to the bottom of the straight edge. Since the bending moment is much greater at the top and bottom regions of the straight edge, this practice leads to more frequent displacements of the top and bottom edges of the straight edge and thus uneven joint lines occur between adjacent wall covering sheets.

SUMMARY OF THE INVENTION

An apparatus useful for assisting in cutter edging overlapping sections of adjacent surface coverings comprising an elongated body portion with at least one straight side, and at least one slot parallel with the straight side of the elongated body portion and penetrating through and extending substantially the length of the body portion.

In the apparatus, the body portion may have at least two slots therein extending substantially the length of the body portion. One side of the body portion of the apparatus may have hollowed out areas between the slots and the longitudinal edges of the body portion.

In the apparatus, longitudinal ridges running substantially the length of each longitudinal side of the body portion, may be formed on each side of the hollowed out areas adjacent the longitudinal slots. A measuring gradient may be embossed or imprinted on one elongated side of the body portion.

DRAWINGS

In drawings which illustrate a specific embodiment of the invention, but which should not be construed as restricting or limiting the spirit or scope of the invention in any way:

DETAILED DESCRIPTION OF THE SPECIFIC EMBODIMENT OF THE INVENTION

Figure 1:
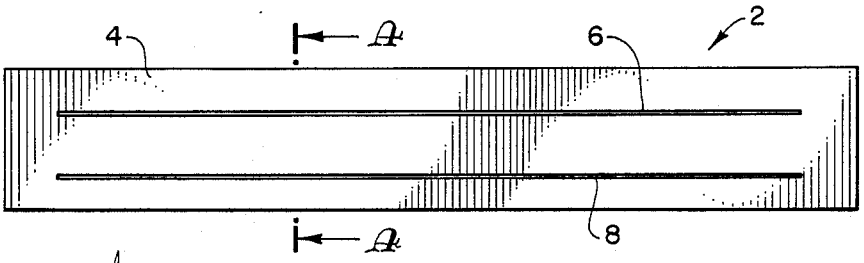
FIG. 1 illustrates a plan view of the double cut edge.

Wall coverings, and particularly vinyl backed wall coverings made of various fabrics, have become increasingly popular for covering the interior walls of commercial buildings and residential homes. These wall coverings usually are manufactured and sold in rolls which measure fifty-four inches in length, that is, the width of the wall covering sheet drawn off the roll is fifty-four inches. When such wall coverings are installed on walls usually, but even ceiling and floors on occasion, it is customary at the joints between parallel sheets to overlap adjacent sheets one and a half to two inches. This technique is often called "doublelap". Then, the installer will typically use a straight edge to cut through the two overlapping sheets along the the overlap. As explained previously it is difficult for the installer when he uses an ordinary straight edge, unless he is extremely careful, to cut a straight cut along the entire length of the overlap.

I have invented a double cut edger which facilitates the cutting of straight cuts on doublelap vinyl backed wall coverings. The edger is illustrated in the drawings which accompany this disclosure.

Referring to FIG. 1, which illustrates a plan view of the double cut edger 2, it can be seen that it is constructed of a rectangular body 4, with a "one inch" slot 6 cut along most of the length of and an inch away from the logitudinal side of the upper area of the body, and a second "three quarter inch" slot 8 cut along most of the length of the lower area of the body 4 and $\frac{3}{4}''$ away from the lower longitudinal side of the body 4. The "one inch" slot is for cutting two inch doublelap whereas the "three quarter inch" slot is for cutting $1\frac{1}{2}$ inch doublelap. It will be recognized that other slot widths are possible to deal with other widths of doublelap.

Figure 2:
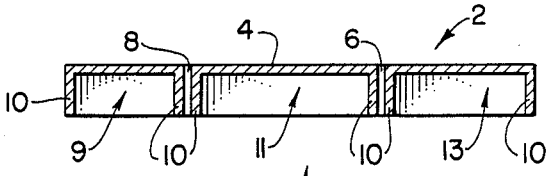
FIG. 2 illustrates a end view of the double cut edger taken along section line A—A of FIG. 1.

The double lap edger 2 can be constructed of a solid piece, such an aluminum bar, or the like. However, if the edger 2 is constructed of a solid metal, it tends to be heavy and cumbersome. Thus, it is preferred that the weight of the edger 2 be reduced. One way to do this is illustrated in FIG. 2, which represents an end view of the double lap edger 2 taken along section line A—A of FIG. 1. The "three quarter inch" slot 8 and the "one inch" slot 6 are shown. However, on the bottom surface of the body 4, three areas 9, 11 and 13 are hollowed out substantially the length of the body 4. Not only do these hollowed areas 9, 11 and 13 reduce the weight of the edger 2, but they also provide six separate ridges 10 which enhance the ability of the edger 2 to grip the wall coverings when the installer holds the edger 2 against the overlapped area of the wall covering.

Figure 3:
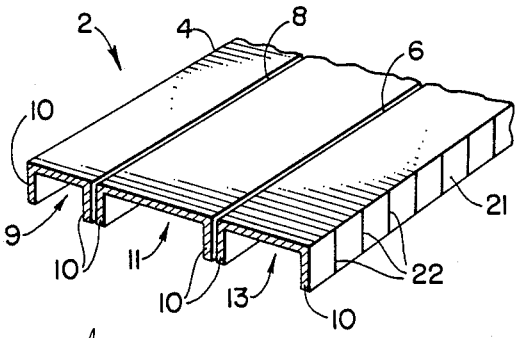
FIG. 3 illustrates a perspective view a wall covering installer using the double cut edger and a cutting knife.

FIG. 3 illustrates an installer 14 holding the body 4 of the edger 2 against the wall, and running a cutter 12 along one of the slots 8 of the edger. As can be seen in FIG. 3, the edger body 4 is placed over the overlap of the wall covering 16. The visible edge of the overlapped area of the wall covering is designated by lead line 18. The installer 14 lines up one side of the body 4 so that it aligns with the edge 18 both above and below the edger 2. The hidden edge of the adjacent wall covering is indicated by lead line 17. The "one inch" slot is selected for 2" overlap while the "three quarter inch" slot is selected for 1½ inch overlap. Once the installer 14 has lined up the body 4 so that one side of the edger 2 aligns with visible edge 18 both above and below the body 4, then the installer 14 inserts the cutting blade of a cutter knife 12 into the slot 8 and draws it downwardly from the top to the bottom of the slot 8. The installer 14 then keeps the cutting blade 12 in position against the wall through the slot while he slides the body 4 downwardly so that the cutter 12 is again positioned at the top end of the slot 8. The installer 14 then repeats the process as required by drawing the cutter 12 from the top to the bottom of the slot 8. When the cutter 12 is held in position at the bottom of the most recently made cut and the body 4 is moved down so that the cutter 12 is then at the top of slot 8, it is only necessary to align the bottom edge of the edger 2 with the visible edge 18 of the wall covering. This increases the speed at which a double cut can be made.

The inventor has discovered that not only is the edger 2 vastly superior to an ordinary straight edge in enabling a straight cut to be made along the length of the overlap of adjacent wall covering sheets, but it is also much faster than a conventional straight edge. This is because the installer 14 can rapidly draw the cutter 12 to the bottom of slot 8, after which the edger 2 can be rapidly moved downwardly with the cutter 12 held in position in the slots, whereupon the cut can be continued. It is only necessary to align the bottom edge of the edger 2 each time at the end of a cut. Once the cut has been made through the overlap, then the extraneous strips of the overlapping section are removed.

Figure 4:
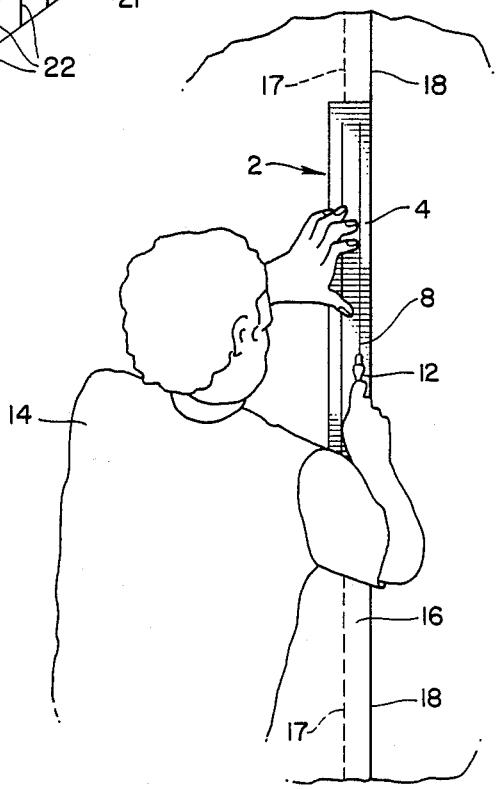
FIG. 4 illustrates a measuring gradient on one side of the double cut edger of FIG. 1.

As indicated in a general way in FIG. 4, a measuring gradient may be embossed or imprinted on one elongated side of the body portion 4 of the double cut edger 2.

As will be apparent to those skilled in the art, in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention which an exclusive property or privilege is claimed are defined as follows:

1. An apparatus for assisting in cutting overlapping sections of adjacent surface coverings comprising:

(a) an elongated body portion having two elongated sides and first and second parallel straight edges along respective elongated sides;

(b) a first slot with vertical walls parallel with the first straight edge of the elongated body portion, said first slot being located at a specified distance from the first straight edge, and penetrating through the depth of and extending substantially the length of the elongated body portion;

(c) a second slot with vertical walls parallel with the second straight edge of the elongated body portion, said second different from the specified distance that the first slot is located from the first straight edge, and penetrating through the depth of and extending substantially the length of the elongated body portion; and (d) elongated ridges located along each longitudinal side of the first and second slots on the underside of the elongated body portion, said ridges extending substantially the length of the elongated body portion.

2. An apparatus as defined in claim 6 wherein the underside of the elongated body portion has hollowed out areas between the first and second slots and between the first and second slots and the respective elongated sides of the body portion.

3. An apparatus as defined in claim 2 wherein elongated longitudinal ridges are located on the underside of the elongated body portion along substantially the length of each elongated side of the elongated body portion.

4. An apparatus as defined in claim 3 wherein a measuring gradient is embossed or imprinted on one elongated side of the body portion.

5. An apparatus as defined in claim 3 wherein the elongated body portion is flat on the top surface thereof and the first and second parallel straight edges are vertical relative to the flat top surface.

6. An apparatus as defined in claim 5 wherein the first slot is located ¾ of an inch from the first parallel straight edge.

7. An apparatus as defined in claim 5 wherein the first slot is located on inch from the first parallel straight edge.

* * * * *